United States Patent [19]

Gassmann

[11] 4,066,888

[45] Jan. 3, 1978

[54] ENCLOSED HIGH-PRESSURE ELECTRIC DISCHARGE LAMP STRUCTURE WITH CABLE TERMINAL

[75] Inventor: Michael Gassmann, Munich, Germany

[73] Assignee: Patent-Treuhand-Gesellschaft fur elektrische Gluhlampen mbH, Munich, Germany

[21] Appl. No.: 702,982

[22] Filed: July 6, 1976

[30] Foreign Application Priority Data

July 14, 1975 Germany ..... 7522386[U]

[51] Int. Cl.[2] ..... F21S 3/00

[52] U.S. Cl. ..... 362/223; 313/49; 362/329; 362/313

[58] Field of Search ..... 240/92, 51.11 R, 51.11 A; 313/48, 49, 50, 51

[56] References Cited

U.S. PATENT DOCUMENTS

| | | | |
|---|---|---|---|
| 1,962,106 | 6/1934 | Thompson | 313/51 X |
| 2,227,739 | 1/1941 | Pollard | 240/51.11 R X |
| 2,569,143 | 9/1951 | Bennett | 240/51.11 R |
| 2,822,508 | 2/1958 | Rabette | 313/49 X |
| 3,539,969 | 11/1970 | Johnson et al. | 240/51.11 R |
| 3,808,495 | 4/1974 | Win | 240/92 X |
| 3,815,080 | 6/1974 | Summa | 240/51.11 R X |

*Primary Examiner*—Edna M. O'Connor
*Attorney, Agent, or Firm*—Flynn & Frishauf

[57] ABSTRACT

The double-ended lamp has a base at each end, one of which is connected to a cable. To prevent scattering of the high-pressure lamp bulb in case of explosion for example due to improper handling before installation, it is enclosed within a transparent protective tube, secured at its ends by caps slipped over the respective bases. To hold the caps and hence the tube in place, and prevent rolling of the bulb enclosed by the tube in the tubular end caps, the connecting cable is passed out of one end base from the side and it is of such length that it can be stretched adjacent the tube enclosure of the lamp to the other base, to be there fastened by a cable connector to the base pin terminal by a wing nut, or the like.

9 Claims, 1 Drawing Figure

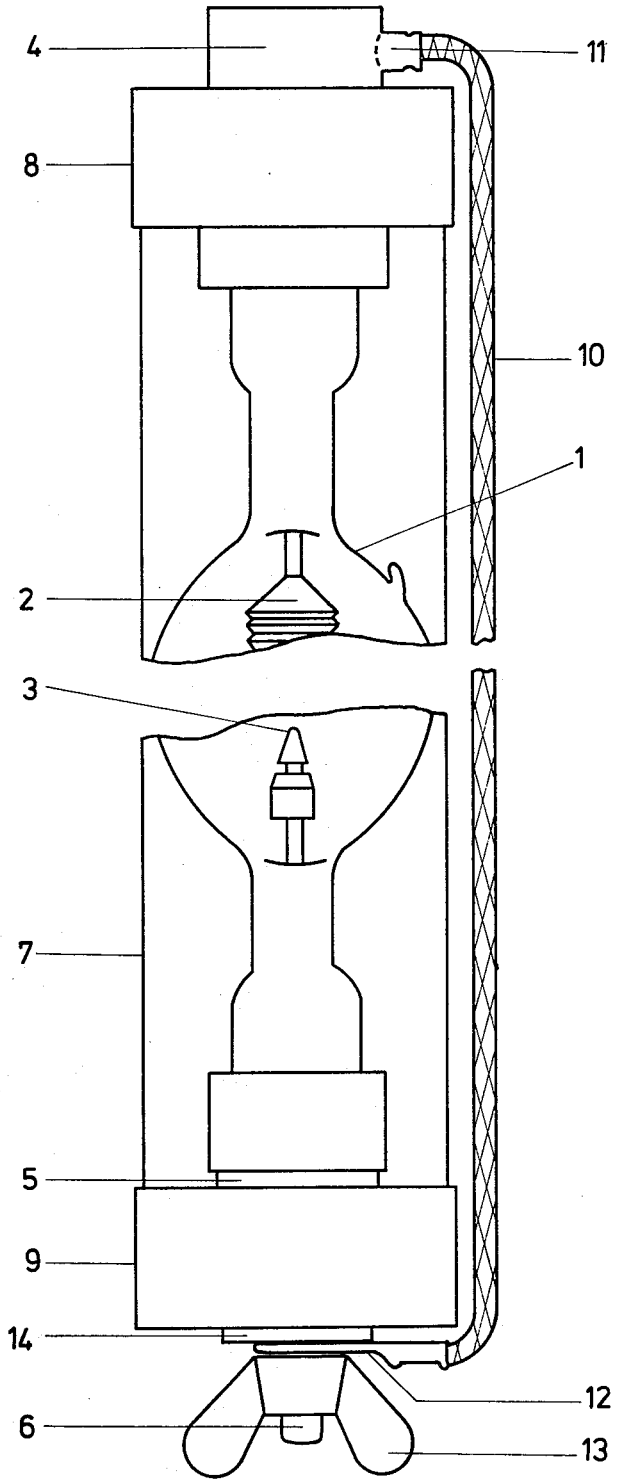
4
11
8
10
1
2
3
7
5
9
14
12
6
13

ENCLOSED HIGH-PRESSURE ELECTRIC DISCHARGE LAMP STRUCTURE WITH CABLE TERMINAL

The present invention relates to protection of a double-ended, high-pressure electric discharge lamp, and more particularly to protection against shattering and explosion of such a lamp which has a connecting cable permanently secured at one end to the lamp, the other end of the lamp having a plug or pin with a separable screw-on connection stud. Prior to use the lamp is enclosed in a protective transparent tube of insulating material, secured in caps slipped over both ends of the lamp through central openings formed in the caps.

It is known to provide high-pressure lamps which have a socket at each end, each socket having a central connection pin. For protection prior to installation in electrical fittings, the lamps are usually enclosed in transparent tubings to surround the light bulb. End caps at the basis hold the tube in place. The base pin provided at each end of the lamp protrudes through a central opening in the respective cap. The caps are held on the tubular protective covering by a rigid metal strap which is slipped over the caps externally and surrounds the base pins. The tight grip of the tube in the caps, by means of the strap, prevents the lamp components from being scattered if the lamp bulb should, per chance, explode. The strap has an additional function: It acts as an anti-roll restraint to prevent the tubular lamp, and its bases, from rolling off a support surface, for example from rolling off a table on which it has been placed, and hence breaking upon falling.

Double-ended, a high-pressure electric discharge lamps are also known in which the base at one end of the lamp does not have a base pin, but rather is provided with a securely and permanently attached connecting cable.

It is an object of the present invention to provide high-pressure, explosion-protected discharge lamps which require lesser number of parts, are easy to make and are easily assembled and locked together for shipment.

SUBJECT MATTER OF THE PRESENT INVENTION

Briefly, the connecting cable is securely attached to one of the lamp bases, and then passed close to and along the outer wall surface of the protective tube in stretched condition to extend to the base pin at the other end of the lamp, where it is detachably connected to the terminal bolt or pin of the other base, for example by a wing nut. It is laterally inserted into the base, preferably as the connection at the anode end of the lamp and connected inside the base with the electrode rod by soldering, and additionally clamped therein, for example by a compression connector. The connection lug on the cable is preferably open-ended so that, after shipment, it can be readily removed by loosening the wing nut from the other connecting terminal, that is from the pin or bolt. The tube protecting the lamp is made of transparent plastic. The cable which is attached to the lamp during shipment and handling, prevents rolling off of the lamp from flat surfaces during handling and shipping.

The assembly has the advantage that no additional material or strap is required to lock the protective covering in place; the cable which serves as a lead connection serves this purpose before installation of the lamp in its receiving socket. The length of the cable is so selected that it extends, with its connector lug, just from one base to the other, closely fitting and tightly stretched along the protective tube. Thus, the caps are reliably fixed on the protective tube during shipment and, upon fracture of the lamp under high pressure, component parts are prevented from being expelled about. The lamp, simultaneously, is prevented from rolling on a surface.

The invention will be described by way of example with reference to the accompanying drawings, wherein the single FIGURE is a schematic side view of the lamp structure in accordance with the present invention.

A high-pressure xenon discharge lamp 1 has an anode 2 and a cathode 3, and is supplied with bases 4, 5. Base 5, at the cathode end of the lamp, is provided with a central threaded connection bolt or pin 6. The lamp is enclosed within a protective housing which is formed as a tube 7 of transparent plastic. Tube 7 is held in place by caps 8, 9, slipped over the ends of the tube. Caps 8, 9 are likewise made of plastic, closing off the tube 7. Each of the caps 8, 9 is formed with a central opening. Cap 9, at the cathode end of the lamp, has a somewhat smaller opening than cap 8 at the anode end. Through this smaller opening of cap 9 extends the pin 6. Connecting cable 10 is laterally connected in base 4; it is rigidly pinched or clamped in a connecting lug 11 and soldered to the electrode rod extending from the anode to the base 4. To facilitate assembly, the cap 8 is formed with a lateral notch at the edge of the central opening so that the clamp extension or nipple 11 can be passed therethrough.

In accordance with a feature of the invention, the cable 10 is so dimensioned that it is held straight and under tension and lies tightly adjacent tube 7, extending up to the bolt 6. The cable is terminated in an open-ended cable terminal 12 which fits around the terminal bolt 6, to which it is secured by a wing nut 13. A washer 14 is interposed between the cap 9 and the wing nut 13.

To install the lamp 1, the cable 10 is detached from pin 6, and cap 9 is removed from tube 7. The lamp 1, still enclosed within tube 7, is then screw-fitted with its pin 6 in a standard receiving socket and tube 7, interconnected with cap 8, is removed by withdrawal from the free end of the lamp 1. Cable 10, rigidly connected to lamp base 4, is thereafter connected to the other pole of the voltage source (not shown).

I claim:

1. Double-ended, elongated high-pressure electric discharge lamp having a pair of terminals, a lamp base (4, 5) at either end of the lamp, the bases being connected to respective lamp terminals, a connecting pin or bolt (6) at one base (5), a connection cable (10) rigidly mounted to and connected to the other base (4) in combination with a removable protective transparent tube (7) of insulating material enclosing the lamp, end caps (8, 9) fitted over both ends of the lamp, at least one end cap (9) having a central opening, the pin or bolt (6) extending through one (19) of the caps, wherein the connection cable (10) is passed close to and along the outer wall surface of the tube in stretched condition and has a length to extend from said other base (4), up to the pin or bolt (6) of said one lamp base (5), said cable being detachably secured to the pin or bolt (6) immediately adjacent the respective end cap (9).

2. Lamp according to claim 1, wherein the removable protective tube (7) is made of transparent plastic.

3. Lamp according to claim 1, wherein one of the terminals is an anode terminal and the connection cable (10) is laterally fitted in the base (4) and connected to the anode terminal of the lamp.

4. Lamp according to claim 1, wherein one of the terminals is a cathode terminal and an open connector lug (12) is provided secured to the cable (10) at the free end thereof, the connector lug being attached to the base pin or bolt (6) forming the cathode terminal of the lamp.

5. Lamp according to claim 1, wherein the pin or bolt at the one lamp base (5) is threaded, a nut (13) is threaded on the bolt, a connector lug (12) is connected to the cable at the free end thereof and releasably clamped to the base pin or bolt (6) by the nut (13) in tightly stretched condition positioned adjacent the outer wall surface of the tube to securely hold the cap in place during shipment and prevent rolling of the lamp within the protective tube on a surface.

6. Lamp according to claim 5, wherein the threaded nut is a quick-release wing nut (13).

7. Lamp according to claim 6, wherein the connection cable (10) is laterally fitted in the base (4) and connected to the anode terminal of the lamp;

and wherein the protective tube (7) is made of transparent plastic.

8. Lamp according to claim 7, wherein the connector lug (12) is an open-ended connector.

9. Lamp according to claim 5, wherein the connector lug (12) is an open-ended connector.

* * * * *